US006244887B1

(12) United States Patent
Commerci et al.

(10) Patent No.: US 6,244,887 B1
(45) Date of Patent: Jun. 12, 2001

(54) ELECTRICAL CONNECTOR ASSEMBLY

(75) Inventors: Joseph D. Commerci, Elmhurst; Kirk B. Peloza, Lisle, both of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/273,138

(22) Filed: Mar. 19, 1999

(51) Int. Cl.[7] ..... H01R 13/28

(52) U.S. Cl. ..... 439/284; 439/293; 439/660; 439/701; 439/862

(58) Field of Search ..... 439/284, 660, 439/293, 295, 862, 701

(56) References Cited

U.S. PATENT DOCUMENTS

| | | | | |
|---|---|---|---|---|
| 4,521,065 | * | 6/1985 | Nestor et al. | 439/660 |
| 4,657,320 | | 4/1987 | Bamford et al. | 339/4 |
| 4,737,118 | * | 4/1988 | Lockard | 439/660 |
| 5,183,409 | | 2/1993 | Clever et al. | 439/291 |
| 5,199,884 | | 4/1993 | Kaufman et al. | 439/74 |
| 5,498,167 | * | 3/1996 | Seto et al. | 439/284 |
| 5,520,545 | | 5/1996 | Sipe | 439/65 |
| 5,575,674 | | 11/1996 | Davis et al. | 439/284 |
| 5,727,961 | * | 3/1998 | Landis et al. | 439/660 |
| 5,947,774 | * | 9/1999 | Abe | 439/701 |

* cited by examiner

*Primary Examiner*—Paula Bradley
*Assistant Examiner*—Truc Nguyen
(74) *Attorney, Agent, or Firm*—Stephen Z. Weiss

(57) ABSTRACT

An electrical connector assembly includes a pair of hermaphroditic connectors having opposed mating faces which are juxtaposed generally along a plane when the connectors are mated. The connectors are adapted for mating in either opposite direction generally parallel to the plane of the mating faces. Each connector includes an elongated housing having an engaging flange at one end and a locking hook at an opposite end for embracing the engaging flange of the other hermaphroditic connector to lock the connectors against unmating in a direction generally perpendicular to the plane of the mating faces. The engaging flange and the locking hook of the pair of hermaphroditic connectors have opposing abutment surfaces that are elongated in the mating direction of the connectors. At least one of the opposing abutment surfaces has a central abutment portion generally parallel to the mating direction and inclined ramp portions at opposite ends of the central abutment portion in the mating direction. This configuration of the opposing abutment surfaces minimizes binding of the housings if attempts are made to mate the connectors in relatively skewed orientations.

16 Claims, 6 Drawing Sheets

ELECTRICAL CONNECTOR ASSEMBLY

FIELD OF THE INVENTION

This invention generally relates to the art of electrical connectors and, particularly, to an electrical connector assembly which minimizes binding during mating of a pair of connectors, such as a pair of hermaphroditic connectors.

BACKGROUND OF THE INVENTION

Generally, an electrical connector includes some form of dielectric or insulating housing which mounts one or more conductive electrical terminals. The terminals have contact portions which are adapted for engaging the contact portions of the terminals of a complementary mating electrical connector or other connecting device. In an electrical connector assembly, a pair of mating connectors are interconnected for establishing one or more electrical circuits through the assembly interface.

Electrical connectors are used in a wide variety of applications. They may interconnect discrete electrical wires or they may interconnect a plurality of printed circuit boards or they may interconnect discrete wires with circuit traces on a circuit board, for instance. Electrical connectors also are used in a wide variety of environments, such as through panels or backplanes as well as in "drawer" applications, for instance.

In many applications, interconnecting electrical connectors are complex and expensive, involving one type of connector (such as a male or plug connector) and still another type of connector (such as a female or receptacle connector). In some instances, a pair of hermaphroditic connectors are used in an electrical connector assembly to simplify the assembly and reduce its costs. One type of hermaphroditic connector system includes a pair of hermaphroditic connectors having opposed mating faces which are juxtaposed generally along a plane when the connectors are mated. The connectors are adapted for mating in directions generally parallel to the plane of the mating faces. There have been certain problems with these types of connectors, such as binding of the connectors when the housings are mated in a slightly skewed condition, particularly when the housings are elongated. Other problems involve the contact forces changing significantly when the opposing contacts engage at different positions at the mating faces between the connectors. The present invention is directed to solving these various problems and to providing simple, inexpensive and effective hermaphroditic electrical connectors.

SUMMARY OF THE INVENTION

An object, therefore, of the invention is to provide a new and improved electrical connector assembly which minimizes binding of the connector housings when mating of a pair of connectors.

Another object of the invention is to provide such a connector as a hermaphroditic connector.

In the exemplary embodiment of the invention, a pair of hermaphroditic connectors have opposed mating faces which are juxtaposed generally along a plane when the connectors are mated. The connectors are adapted for mating in either opposite direction generally parallel to the plane of the mating faces.

Each hermaphroditic connector includes an elongated housing having an engaging flange at one end and a locking hook at an opposite end for embracing the engaging flange of the other hermaphroditic connector to lock the connectors against unmating in a direction generally perpendicular to the plane of the mating faces. The engaging flanges and the locking hooks of the pair of hermaphroditic connectors have opposing abutment surfaces that are elongated in the mating direction of the connectors. At least one of the opposing abutment surfaces has a central abutment portion generally parallel to the mating direction. Inclined ramp portions are disposed at opposite ends of the central abutment portion in the mating direction to minimize binding of the housings if attempts are made to mate the connectors in relatively skewed orientations.

The invention contemplates that the engaging flange and the locking hook be provided with a number of the opposing abutment surfaces. For instance, the opposing abutment surfaces of the pair of hermaphroditic connectors face each other in the longitudinal direction of the elongated housing. Additional opposing abutment surfaces of the pair of hermaphroditic connectors face each other generally perpendicular to the mating faces of the connectors.

As disclosed herein, the engaging flange has a generally rectangular cross-section defining four sides. Two sides are formed with one of the abutment surfaces including a central abutment portion and inclined ramp portions. Correspondingly, the locking hook has four inner sides opposing the four sides of the engaging flange. Two of the four inner sides of the locking hook is formed with one of the abutment surfaces including a central abutment portion and inclined ramp portions.

According to another aspect of the invention, the central abutment portion of the opposing abutment surfaces comprises less than 50% of the length of the abutment surface. According to another aspect of the invention, the central abutment portion of the opposing abutment surfaces is generally flat, and the inclined ramp portions are inclined up to 4° relative to the flat abutment portion.

Finally, the invention contemplates that a first pull tab project from the elongated housing intermediate opposite ends thereof to facilitate unmating of the connectors. Second pull tabs may be located at each opposite end of the elongated housing to further facilitate unmating of the connectors.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
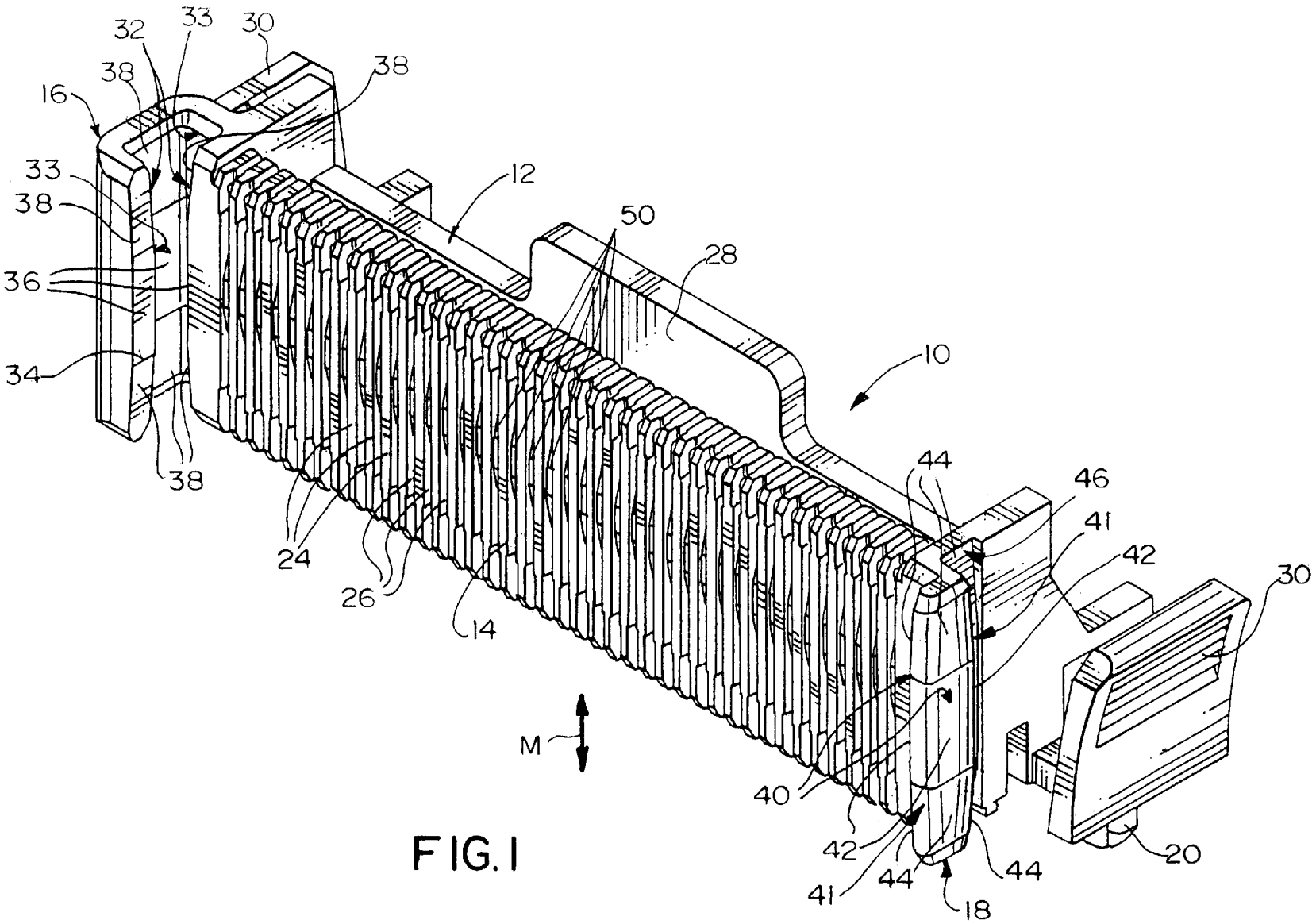
FIG. 1 is a perspective view looking at the mating face of a hermaphroditic connector with some terminals shown embodying the concepts of the invention.
Figure 2:
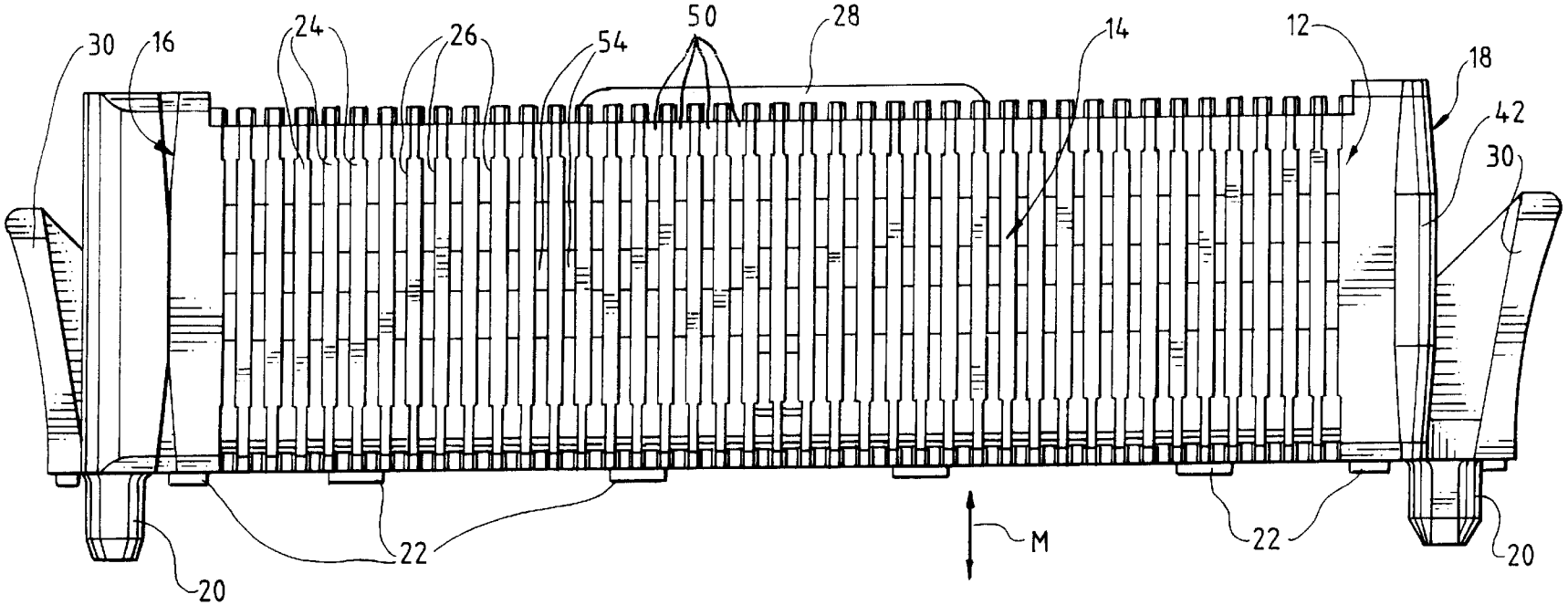
FIG. 2 is a front elevational view of the connector.
Figure 3:
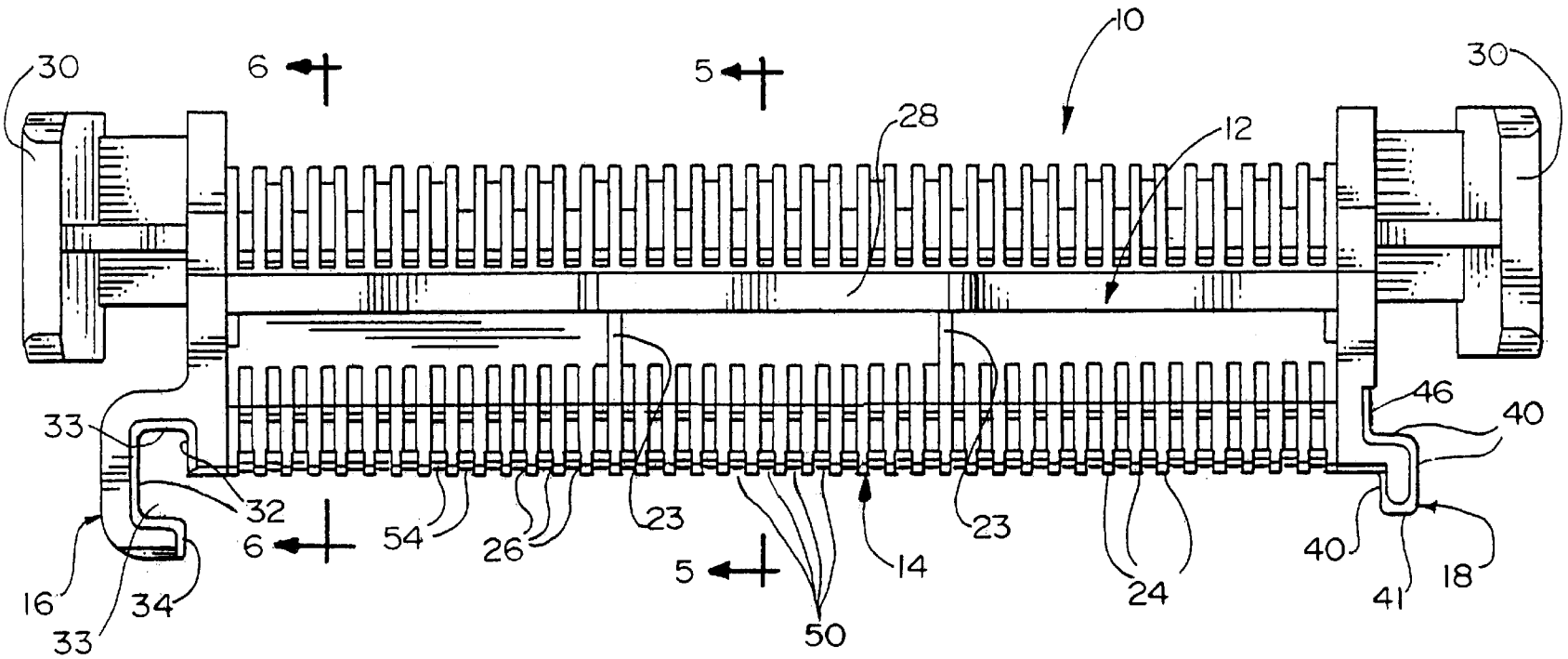
FIG. 3 is a top plan view of the connector.

Referring to the drawings in greater detail, and first to FIGS. 1–3, the invention is embodied in a hermaphroditic electrical connector, generally designated 10. A pair of the hermaphroditic connectors are shown in mated condition in FIG. 4 and will be described hereinafter.

Referring first to FIGS. 1–3, hermaphroditic connector 10 includes an elongated dielectric housing, generally designated 12, defining a mating face, generally designated 14, whereby the mating faces of a pair of the connectors are juxtaposed generally along a plane when the connectors are mated in the direction of double-headed arrow "M".

Generally, complementary interengaging latch means are provided on housing 12 of each connector 10 to lock a pair of the connectors against unmating in a direction generally perpendicular to the plane of mating faces 14. In particular, the complementary interengaging latch means are provided by a locking hook, generally designated 16, at one end of the housing for embracing an engaging flange, generally designated 18, at the opposite end of the housing of the mating connector. FIG. 2 shows a pair of mounting posts 20 depending from opposite ends of the housing for insertion into appropriate mounting holes in a printed circuit board (not shown). FIG. 2 also shows a plurality of standoffs 22 at the bottom of the housing for elevating the housing slightly above the surface of the printed circuit board. A pair of support ribs 23 extend transversely of the longitudinal direction of the housing.

Mating face 14 of each hermaphroditic connector 10 actually is defined by a plurality of longitudinally spaced ribs 24 defining a plurality of grooves 26 therebetween. A plurality of terminals are mounted in the housing and include contact portions disposed in the grooves between the ribs, as will be described in greater detail hereinafter.

In order to facilitate unmating of a pair of the hermaphroditic connectors 10, an upwardly projecting first pull tab 28 is provided intermediate opposite ends of housing 12. This first pull tab can be grasped with a pair of pliers. In addition, a pair of second pull tabs 30 also are provided projecting from opposite ends of the housing for grasping between the thumb and forefinger of an operator.

Locking hook 16 and engaging flange 18 which define the complementary interengaging latch means between a pair of the hermaphroditic connectors 10 have opposing abutment surfaces that are elongated in the mating direction of the connectors and which are configured with inclined ramp portions to prevent the housings from binding when the connectors are mated in slightly skewed orientations. More particularly, locking hook 16 has two inner sides 32 and an edge 34 all with inclined ramp portions 38 and inner sides 33 each comprising one flat surface which define abutment surfaces that are elongated in the mating direction of the connector. Inner sides 32 and edge 34 have "non-binding" configurations. Each inner side 32 and edge 34 include a central, generally flat abutment portion 36 which is generally parallel to the mating direction of the connectors. Inclined ramp portions 38 are formed at opposite ends of each central abutment portion 36 in the mating direction of the connectors. These inclined ramps minimize binding of the housings of the connectors when attempts are made to mate the connectors in relatively skewed orientations.

Correspondingly, engaging flange 18 of each hermaphroditic connector has a generally rectangular cross-section defining two sides 40 and slot 46 all with inclined ramp portions 44 and two sides 41 each comprising one flat surface edge parallel to the plane of the mating face 14. The two sides 40, two sides 41 and slot 46 of the engaging flange define an abutment surface that is elongated in the mating direction of the connectors and which oppose the four inner sides 32, 33 and edge 34 of locking hook 16 of the mating connector. Sides 40 and slot 46 of engaging flange 18 include a generally flat, central abutment portion 42 generally parallel to the mating direction of connectors, along with inclined ramp portions 44 at opposite ends of the central abutment portion 42 in the mating direction of the connectors. Edge 34 cooperates with slot 46. With this configuration, all of the central abutment portions 42 in sides 40 and slot 46 of engaging flange 18 are opposed to the central abutment portions 36 on the inner sides 32 and edge 34 of locking hook 16. Correspondingly, inclined ramp portions 44 in sides 40 and slot 46 of engaging flange 18 oppose the inclined ramp portions 38 within locking hook 16.

Optimally the inclined ramp portions 38, 44 are inclined up to 4 degrees relative to the central abutment portions 36, 42 respectively or the central abutment portions 36, 42 are less than 50 percent of the length of the respective abutment surface.

Figure 4:
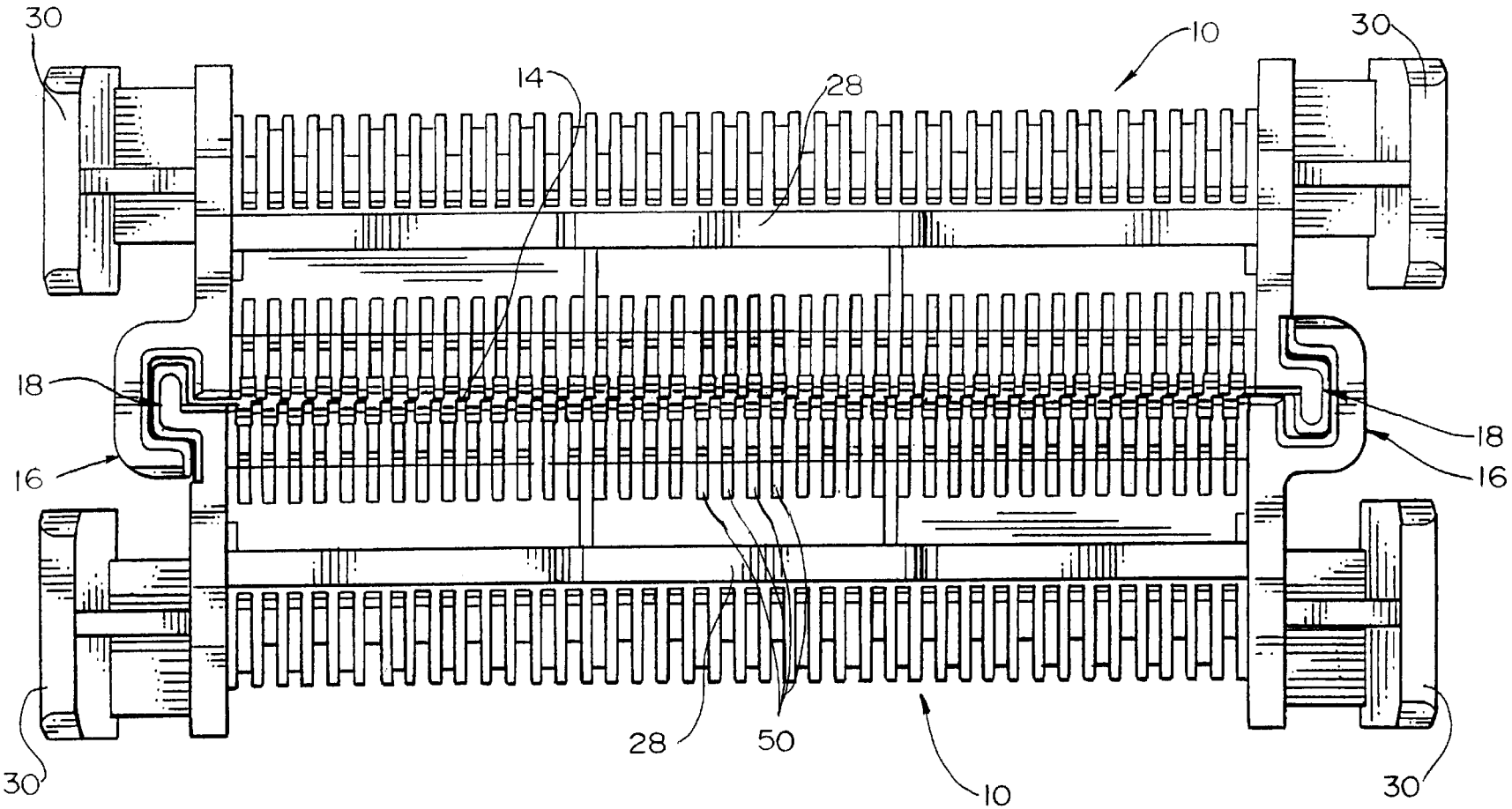
FIG. 4 is a top plan view of a pair of the connectors in mated condition.

FIG. 4 shows two hermaphroditic connectors 10 in mated condition. It can be seen that engaging flange 18 of each hermaphroditic connector is embraced by the locking hook 16 of the other hermaphroditic connector in a pair of the connectors. The locking hooks and the engaging flanges form complementary interengaging latch means to lock the connectors against unmating in a direction generally perpendicular to the plane of mating faces 14 of the connectors.

Figure 5:
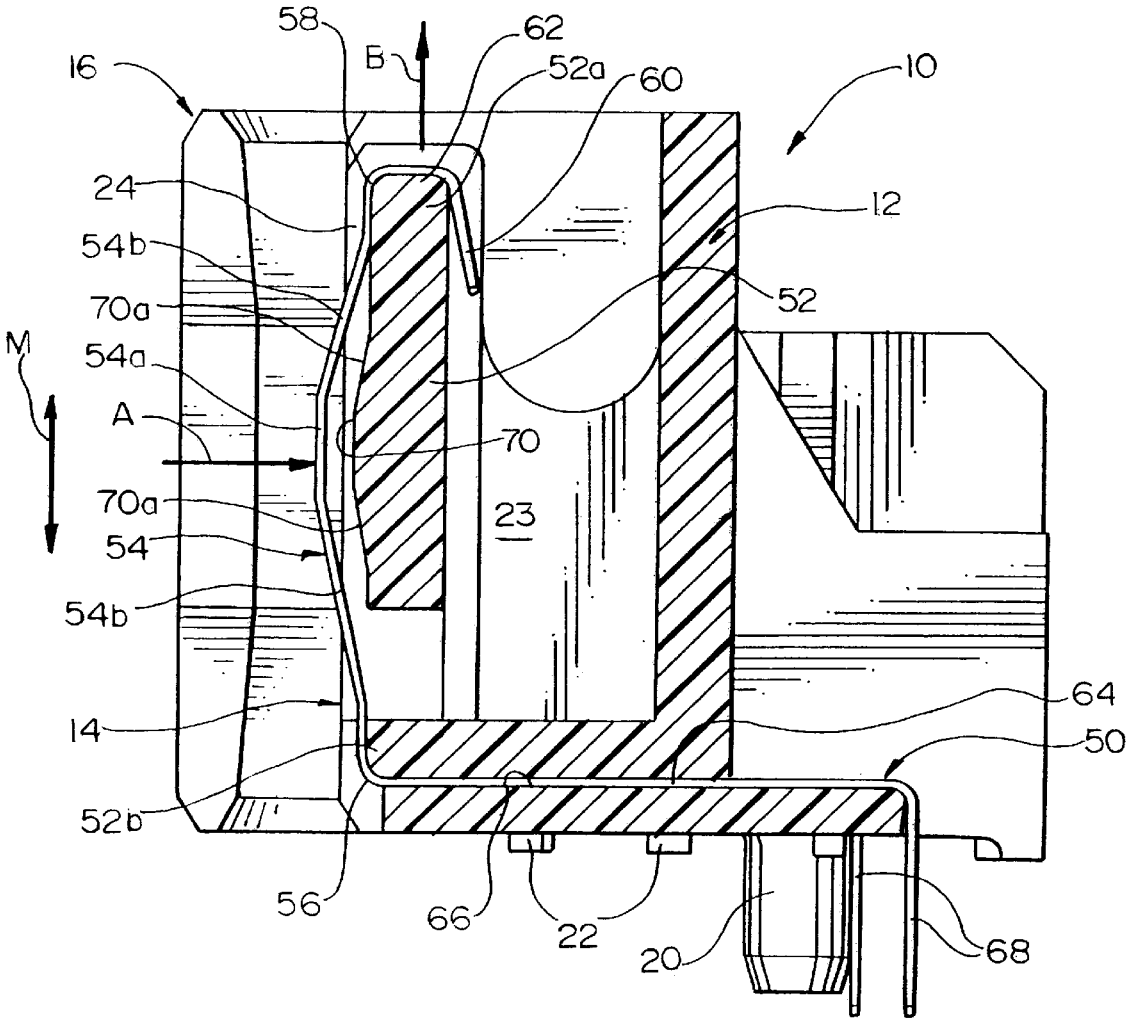
FIG. 5 is a vertical section taken generally along line 5—5 of FIG. 3 with some terminals shown.
Figure 6:
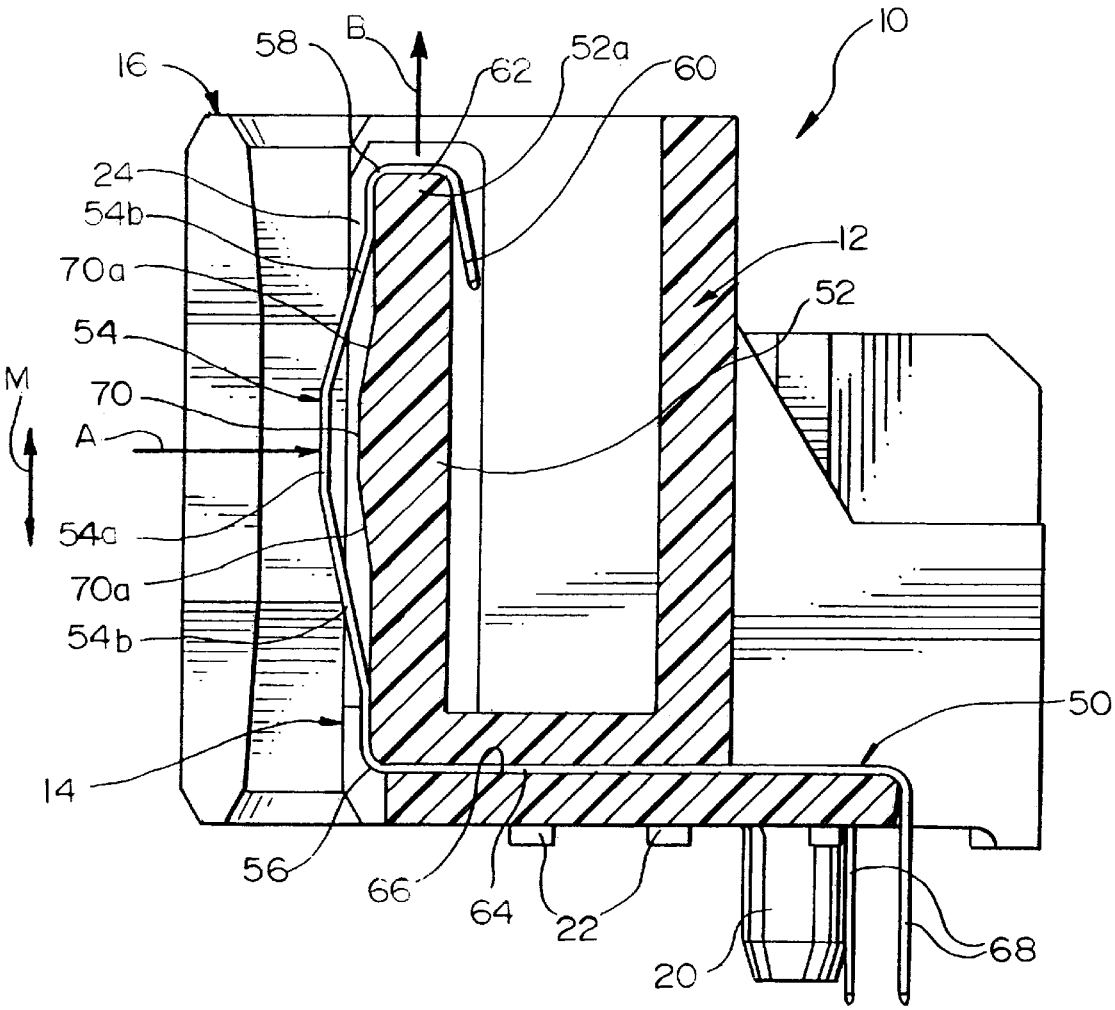
FIG. 6 is a vertical section taken generally along line 6—6 of FIG. 3 with some terminals shown.

FIGS. 5 and 6 show two of the plurality of terminals, generally designated 50, which are mounted on housing 12 and which are spaced along the elongated housing. It can be seen that the housing includes a wall 52 running the length thereof and from which ribs 24 project at mating face 14 of the connector. The wall extends in the mating direction of the terminal and includes a top end 52*a* and a bottom end 52*b*. Each terminal 50 includes a contact portion, generally designated 54, disposed within a groove between a pair of ribs 24. The contact portion bows outwardly from housing wall 52 and mating face 14. The contact portion has a flat contact section 54*a* and ramp sections 54*b* extending from the contact section back toward the housing wall.

The invention contemplates that contact portion 54 of each terminal 50 includes a first, fixed end 56 anchored to housing 12 at bottom end 52*b* of wall 52 and a second, free end 58 which is engageable with the top end 52*a* of wall 52 and slidable relative thereto in the mating direction of the connectors. Contact portion 54, particularly contact section 54*a* thereof, can flex toward and away from wall 50 upon abutting engagement with the contact portion of a corresponding terminal of the mating hermaphroditic connector. In other words, when contact section 54*a* of contact portion 54 engages the contact section of the mating connector terminal, contact portion 54 flexes inwardly toward wall 52 in the direction of arrow "A". This causes the free end 58 of the contact portion to move upwardly in the direction of arrow "B". The result is that there is very little shifting of the contact position with the terminal system or arrangement of the invention.

Still referring to FIGS. 5 and 6, free end 58 of contact portion 54 of each terminal 50 includes a hook 60 which is bent around a top edge 62 of housing wall 52 and embraces top end 52*a* of the wall. This prevents contact portion 54 from moving outwardly away from the wall. Each terminal includes a mounting leg 64 disposed within a channel 66 in housing 12 to anchor fixed end 56 of the contact portion. It is contemplated that housing 12 can be unitarily molded of dielectric material such as plastic or the like, and the housing can be overmolded about mounting legs 64 of the terminals to anchor the terminals in the housing. Finally, the inner ends of mounting legs 64 are bent downwardly to form terminal tails 68 for insertion into appropriate holes in the printed circuit board and for connection, as by soldering, to circuit traces on the board and/or in the holes. It can be seen in FIGS. 5 and 6 that the terminal tails of alternating terminals are offset to define two rows of terminal tails longitudinally of the connector.

Finally, wall 52 of housing 12 is provided with a projection 70 immediately behind contact section 54*a* of contact portion 54 of each terminal. These projections prevent overtravel of the contact portions in flexing toward wall 52. The wall is tapered, as at 70*a*, on opposite sides of projection 70 to eliminate any abrupt recesses in the front face of the wall and into which the contact portion of the terminal might be forced.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly including a pair of hermaphroditic connectors having opposed mating faces which are juxtaposed generally along a plane when the connectors are mated, with the connectors being adapted for mating in either opposite direction generally parallel to said plane of the mating faces, each hermaphroditic connector comprising:

an elongated housing having an engaging flange at one end and a locking hook at an opposite end for embracing the engaging flange of the other hermaphroditic connector to lock the connectors against unmating in a direction generally perpendicular to said plane of the mating faces, the engaging flange and the locking hook of the pair of hermaphroditic connectors having opposing abutment surfaces that are elongated in the mating direction of the connectors, at least one of said opposing abutment surfaces having a central abutment portion generally parallel to the mating direction and inclined ramp portions at opposite ends of the central abutment portion in the mating direction to minimize binding of the housings if attempts are made to mate the connectors in relatively skewed orientations the central abutment portion of at least one of said opposing abutment surfaces comprising less than 50% of the length of the abutment surface in the mating direction of the connectors; and a plurality of terminals mounted on the housing and having contact portions at the mating face for engaging the contact portions at the opposed mating face of the other hermaphroditic connector.

2. The electrical connector assembly of claim 1 wherein said opposing abutment surfaces of the pair of hermaphroditic connectors face each other in the longitudinal direction of the elongated housings.

3. The electrical connector assembly of claim 2 wherein said opposing abutment surfaces are located on the inside of the locking hook and on the outside of the engaging flange.

4. The electrical connector assembly of claim 1 wherein said opposing abutment surfaces on the pair of hermaphroditic connectors face each other in a direction generally perpendicular to said plane of the opposed mating faces of the connectors.

5. The electrical connector assembly of claim 1 wherein said engaging flange has a first side facing longitudinally outwardly of the elongated housing and a second side facing in an opposite direction generally perpendicular to said plane of the opposed mating faces of the connectors, each of said first and second sides being formed with one of said abutment surfaces including a central abutment portion and inclined ramp portions.

6. The electrical connector assembly of claim 5 wherein said locking hook has two inner sides opposing the first and second sides of the engaging flange, each of said two inner sides being formed with one of said abutment surfaces including a central abutment portion and inclined ramp portions.

7. The electrical connector assembly of claim 1 wherein said engaging flange has a generally rectangular cross-section defining four sides, two sides being formed with one of said abutment surfaces including a central abutment portion and inclined ramp portions and two sides being formed into a flat surface, each flat surface generally parallel to the plane of the mating faces.

8. The electrical connector assembly of claim 7 wherein said locking hook has four inner sides opposing the four sides of the engaging flange, two of said four inner sides being formed with one of said abutment surfaces including a central abutment portion and inclined ramp portions and two of the sides being formed into a flat surface, each flat surface generally parallel to the plane of the mating faces.

9. The electrical connector assembly of claim 1, including a first pull tab projecting from said elongated housing intermediate opposite ends thereof to facilitate unmating of the connectors.

10. The electrical connector assembly of claim 1, said housing further including a face mountable on a printed circuit member and including a second pull tab at each opposite end of said elongated housing spaced from said face a distance to allow a thumb and forefinger of an operator to grasp the second pull tabs to facilitate unmating of the connectors.

11. The electrical connector assembly of claim 10, including a first pull tab projecting from said elongated housing intermediate opposite ends thereof to facilitate unmating of the connectors.

12. An electrical connector assembly including a pair of connectors which are mateable in a given mating direction, comprising:

each of said connectors including a housing;

a plurality of terminals mounted on each housing and having contact portions for engaging the contact portions of the mating connector; and complementary interengaging latch means between the connector housings to minimize binding of the housings if attempts are made to mate the connectors in relatively skewed orientations, the complementary interengaging latch means including opposing abutment surfaces on the respective connector housings elongated in the mating direction of the connectors, at least one of the opposing abutment surfaces having a central abutment portion generally parallel to the mating direction and inclined ramp portions at opposite ends of the central portion in the mating direction the central abutment portion of at least one of said opposing abutment surfaces comprising less than 50% of the length of the abutment surface in the mating direction of the connectors.

13. The electrical connector assembly of claim 12 wherein said opposing abutment surfaces of the pair of hermaphroditic connectors face each other in the longitudinal direction of the elongated housings.

14. The electrical connector assembly of claim 12, including a first pull tab projecting from said elongated housing intermediate opposite ends thereof to facilitate unmating of the connectors.

15. The electrical connector assembly of claim 12, said housing further including a face mountable on a printed circuit member including a second pull tab at each opposite end of said elongated housing spaced from said face a distance to allow a thumb and forefinger of an operator to grasp the second pull tabs to facilitate unmating of the connectors.

16. An electrical connector assembly including a pair of hermaphroditic connectors having opposed mating faces which are juxtaposed generally along a plane when the connectors are mated, with the connectors being adapted for mating in either opposite direction generally parallel to said plane of the mating faces, each hermaphroditic connector comprising:

an elongated housing having an engaging flange at one end and a locking hook at an opposite end for embracing the engaging flange of the other hermaphroditic connector to lock the connectors against unmating in a direction generally perpendicular to said plane of the mating faces, the engaging flange and the locking hook of the pair of hermaphroditic connectors having opposing abutment surfaces that are elongated in the mating direction of the connectors, at least one of said opposing abutment surfaces having a central abutment portion generally parallel to the mating direction and inclined ramp portions at opposite ends of the central abutment portion in the mating direction to minimize binding of the housings if attempts are made to mate the connectors in relatively skewed orientations the central abutment portion of at least one of said opposing abutment surfaces being flat and said inclined ramp portions being inclined up to 4° relative to the flat abutment portion in the mating direction of the connectors; and a plurality of terminals mounted on the housing and having contact portions at the mating face for engaging the contact portions at the opposed mating face of the other hermaphroditic connector.

* * * * *